United States Patent [19]

Shinoda et al.

[11] 4,056,583

[45] Nov. 1, 1977

[54] VARIABLE VENTURI CARBURETOR

[75] Inventors: Kazuo Shinoda; Akira Ii, both of Toyota, Japan

[73] Assignee: Toyota Jidosha Kogyo Kabushiki Kaisha, Toyota, Japan

[21] Appl. No.: 596,726

[22] Filed: July 17, 1975

[30] Foreign Application Priority Data

Feb. 7, 1975 Japan ..... 50-15923

[51] Int. Cl.[2] ..... F02M 9/06

[52] U.S. Cl. ..... 261/36 A; 261/44 R; 261/DIG. 56; 261/DIG. 78

[58] Field of Search ..... 261/DIG. 78, DIG. 56, 261/DIG. 58, 36 A, 44 R, 50 R

[56] References Cited

U.S. PATENT DOCUMENTS

| | | | |
|---|---|---|---|
| 2,088,464 | 7/1937 | Chandler et al. | 261/50 R |
| 2,136,959 | 11/1938 | Winfield | 261/50 R |
| 2,250,932 | 7/1941 | Kittler | 261/50 R |
| 2,573,093 | 10/1951 | Burson | 261/50 R |
| 2,926,893 | 3/1960 | Melchior | 261/36 A |
| 3,185,452 | 5/1965 | Mennesson | 261/36 A |
| 3,575,390 | 4/1971 | Bickhaus et al. | 261/62 |
| 3,778,038 | 12/1973 | Eversole et al. | 261/DIG. 56 |
| 3,911,063 | 10/1975 | Barnes, Jr. | 261/DIG. 78 |
| 3,965,221 | 6/1976 | Englert et al. | 261/DIG. 78 |

*Primary Examiner*—Tim R. Miles

*Attorney, Agent, or Firm*—Birch, Stewart, Kolasch and Birch

[57] ABSTRACT

A variable Venturi carburetor having a Venturi portion defined by movable members which are linked with and driven by an accelerating pedal so as to vary the area of its throat opening in accordance with a required engine output power thereby establishing air flow through the Venturi throat at the acoustic speed for the most part of the engine operational region. In high load operation wherein the acoustic speed is not maintained at the Venturi throat, fuel pressure is modified to compensate therefor.

4 Claims, 11 Drawing Figures

VARIABLE VENTURI CARBURETOR

BACKGROUND OF THE INVENTION

1. Field of the Invention

The present invention relates to a carburetor for use with a gasoline engine.

2. Description of the Prior Art

A conventional carburetor is provided with a throttle valve located downstream of a Venturi portion, said throttle valve being adapted to control the amount of intake air of an engine. Such a conventional structure of the carburetor has the drawbacks that when the engine is operated in a low speed low load condition, the speed of the air flow through the Venturi portion is so low that atomization of fuel supplied to the Venturi portion is poor resulting in a non-uniform distribution of fuel to individual cylinders. Also, the transient response characteristic of the fuel supply in acceleration is poor.

SUMMARY OF THE INVENTION

It is the primary object of the present to invention solve the aforementioned problems in the conventional carburetor and to provide a novel and improved carburetor which can constantly supply a good fuel-air mixture over the entire operational region of the engine.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

According to the present invention, the abovementioned object is accomplished by a variable Venturi carburetor for a gasoline engine, comprising a Venturi portion which defines a throat opening, a plurality of fuel delivery ports arranged to traverse said throat opening, and a fuel supply system which supplies liquid fuel to said fuel delivery ports, characterized by movable members which define a wall surface of said Venturi portion, said members being linked with and driven by an accelerating pedal so as to vary the area of said throat opening in accordance with a required output power of the engine.

In the abovementioned variable Venturi carburetor, operation of an accelerating pedal for the control of engine output power effects a change in the area of the throat opening of the Venturi portion instead of a change in the throttling action by the conventional throttle valve in order to accomplish a required control for the amount of intake air of the engine. In this structure, air flow through the Venturi portion can be constantly maintained at a high speed regardless of the engine output power or the amount of the engine intake air. In fact, for the most part of operational region of the engine, the air flow speed through the Venturi throat opening can be increased up to as high as the acoustic speed. By establishing such a high air flow speed at the Venturi throat opening, the fuel ejected into the high speed air flow at the Venturi throat region is atomized quite favorably to provide a desirable fuel air mixture throughout the entire operational region of the engine.

According to a particular feature of the present invention, the fuel supply system which supplies liquid fuel to said fuel delivery port may comprise a variable throttle means which is linked with said movable members so as to vary the throttling ratio thereof in accordance with the variation of said throttle opening area. By this arrangement, it is possible to constantly supply fuel to the air flowing through the Venturi throat portion at the acoustic speed at a rate which is proportional to the opening area of the Venturi throat portion or at the rate of engine intake air supplied through the Venturi portion, thereby constantly maintaining a determined air/fuel ratio regardless of the variation in the rate of engine intake air supplied through the carburetor.

However, since the intake manifold vacuum available in the carburetor generally decreases gradually as the engine load increases beyond a certain high load limit, the speed of air flowing through the Venturi throat lowers below the acoustic speed, whereby the amount of engine intake air no longer increase in proportion to increases of the opening area of the Venturi throat. In view of such a non-linearity of the amount of engine intake air in relation to the opening area of the Venturi throat portion in a high load operation of the engine, according to another particular feature of the present invention, said fuel supply system may further comprise a fuel pressure regulating valve which regulates pressure of the fuel supplied to said variable throttle means so as to be proportional to the level or intake manifold vacuum. By utilizing said fuel pressure regulating valve, the fuel pressure is regulated to compensate for the aforementioned non-linearity in the flowability of the amount of engine intake air relative to the opening area of the Venturi throat, whereby it is made possible to supply fuel constantly in proportion to the air flow, even in the high load region of the engine so that substantially a constant air/fuel ratio is maintained throughout the entire operational region of the engine.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
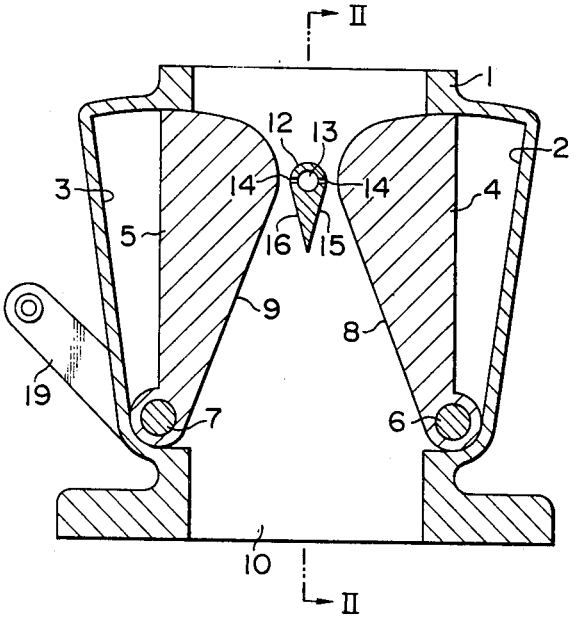
FIG. 1 is a longitudinal section of an embodiment of the variable Venturi carburetor according to the present invention.

Referring to FIG. 1 which shows in a cross section an essential part of an embodiment of the variable Venturi carburetor according to this invention, 1 designates a carburetor body having a rectangular general cross section, wherein sectorially concaved portions 2 and 3 are formed at two opposite wall portions thereof. A pair of these concaved portions receive movable members 4 and 5 supported by pivot shafts 6 and 7, respectively, to be rotatable about their axes. The movable members 4 and 5 have Venturi-shaped faces 8 and 9, respectively, which are adapted to cooperate with a pair of oppositely arranged wall surfaces 10 and 11 of the carburetor body to define the entire wall surface of a Venturi portion of the carburetor.

Figure 2:
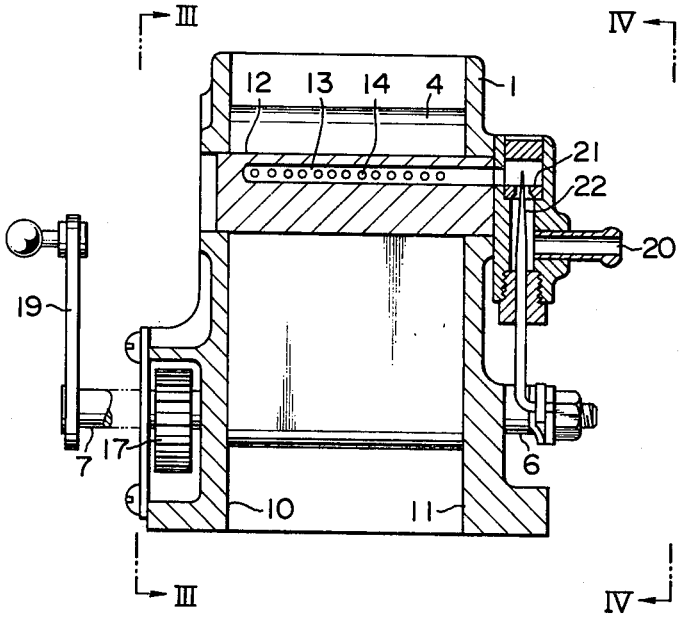
FIG. 2 is a section along line II—II in FIG. 1.

In a throat region of the Venturi portion, a fuel delivery bridge 12 having a vane shape is provided, said bridge extending between the opposite wall surfaces 10 and 11 so as to traverse the Venturi throat opening as better shown in FIG. 2 which shows a section along line II—II in FIG. 1. The fuel delivery bridge 12 is provided with a fuel passage 13 extending therethrough and a number of fuel delivery ports 14 which extend from said fuel passage to open at opposite side faces of the vane shaped fuel delivery bridge. The fuel delivery bridge cooperates with the pair of movable members 4 and 5 to provide a small Venturi portion defined by the face 8 of the movable member 4 and a side face 15 of the fuel delivery bridge 12 as well as another small Venturi portion defined by the face 9 of the movable member 5 and another side face 16 of the fuel delivery bridge 12 for the air flow passing through the Venturi portion.

Figure 3:
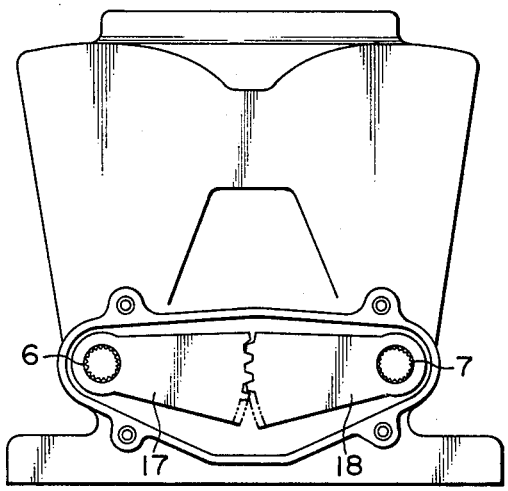
FIG. 3 is a view along line III—III in FIG. 2.

As shown in FIGS. 2 and 3, the latter being a view by line III—III in FIG. 2, the movable members 4 and 5 are operatively connected with sectorial gears 17 and 18, respectively, which are fixedly mounted to the pivot shafts 6 and 7 and meshed with each other. By the meshing cooperation of the sectorial gears, the movable members 4 and 5 are rotated symmetrically to a central axis of the carburetor body 1. An arm member 19 is mounted to the pivot shaft 7, said arm member being adapted to be linked with and driven by an accelerating pedal via a link mechanism (not shown) so that the movable members 4 and 5 are symmetrically opened or closed according to operation of the accelerating pedal.

Figure 4:
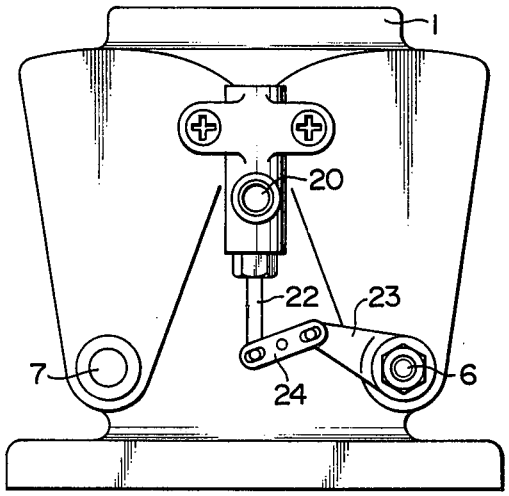
FIG. 4 is a view along line IV—IV in FIG. 2.

As shown in FIG. 2, the fuel passage 13 formed in the fuel delivery bridge 12 is supplied with fuel from a fuel inlet tube 20 by way of a metering jet 21. The metering jet 21 is engaged with a metering rod 22 which has a tapered tip end portion extending through the metering jet 21. As better shown in FIG. 4 which is a view by line IV—IV in FIG. 2, the metering rod 22 is connected with the pivot shaft 6 by a link mechanism including an arm member 23 and a link element 24 so that the metering rod is moved up and down according to rotations of the pivot shaft 6. In more detail, when the pivot shaft 6 is rotated in the clockwise direction as seen in FIG. 1 or 4 in order to increase the opening area of the Venturi throat, the metering rod is pulled downward by way of the arm member 23 and the link element 24 thereby increasing the flow area at the metering jet 21, thus effecting an increased supply of fuel to the fuel passage 13 corresponding to an increased flow of engine intake air effected by the increase of the opening area of the Venturi throat.

The performance of the carburetor shown in FIGS. 1–4 will now be described hereinunder.

Figure 5:
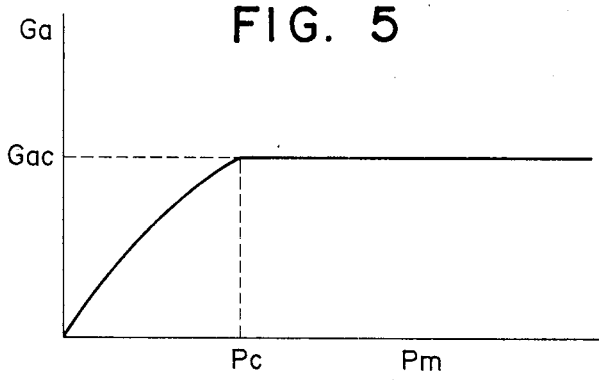
FIG. 5 is a graph showing a relation between intake manifold vacuum and air flow through a Venturi portion.
Figure 6:
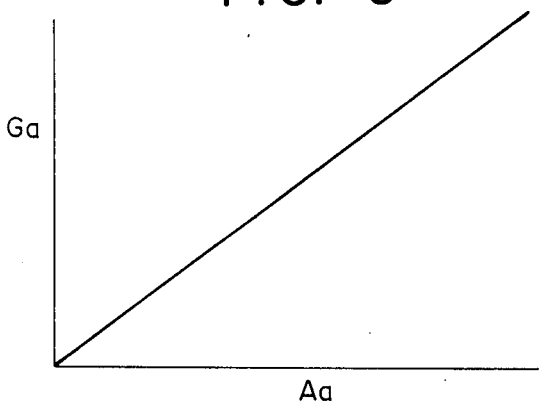
FIG. 6 is a graph showing a relation between opening area of a Venturi throat and air flow therethrough when the air flows at the acoustic speed through the Venturi throat.
Figure 7:
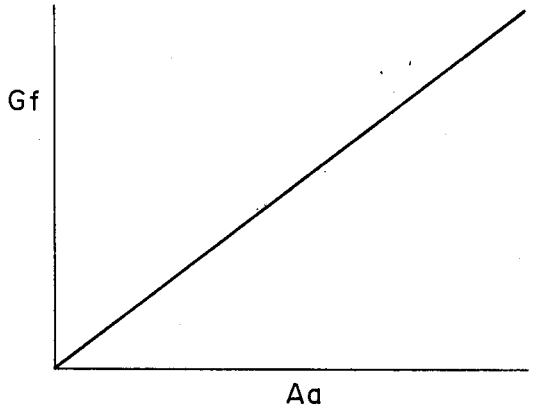
FIG. 7 is a graph showing a relation between opening area of a Venturi throat and fuel flow.

FIG. 5 is a graph which shows change of the amount of engine intake air $Ga$ in relation to intake manifold vacuum $Pm$ under the condition that opening area $Aa$ of the Venturi throat portion defined by the faces 8 and 9 of the movable members 4 and 5 and the wall surfaces 10 and 11 of the carburetor body, is maintained constant. As seen in the figure, when the intake manifold vacuum increases, the amount of intake air increases substantially in proportion to $\sqrt{Pm}$ until the air flow speed at the Venturi throat reaches the acoustic speed at point $Pc$, whereafter the amount of intake air is maintained constant ($Gac$) even when the intake manifold vacuum increases. The vacuum at the point $Pc$ is generally about −70mmHg. Therefore, for most of the operational region of the engine, except at a certain high load region, it is possible to control the amount of engine intake air to be proportional to the opening area of the Venturi throat as shown in FIG. 6 by throttling the Venturi throat portion to the extent of establishing the acoustic speed of the air flow passing through the Venturi throat. On the other hand, if the pressure of the fuel supplied to the fuel inlet tube 20 is maintained constant, the flow of fuel is controlled only by the annular flow area defined by the metering jet 21 and the metering rod 22. Therefore, by properly designing the tapering shape of the tip end portion of the metering rod 22 in relation to the manner of up and down movement of the metering rod effected by rotation of the pivot shaft 6, the fuel flow $Gf$ can be controlled to be proportional to opening area $Aa$ of the Venturi throat portion as shown in FIG. 7. Thus, it is possible to maintain an air/fuel ratio $Ga/Gf$ of the fuel air mixture supplied to the engine to be constant regardless of the operational condition of the engine.

Figure 8:
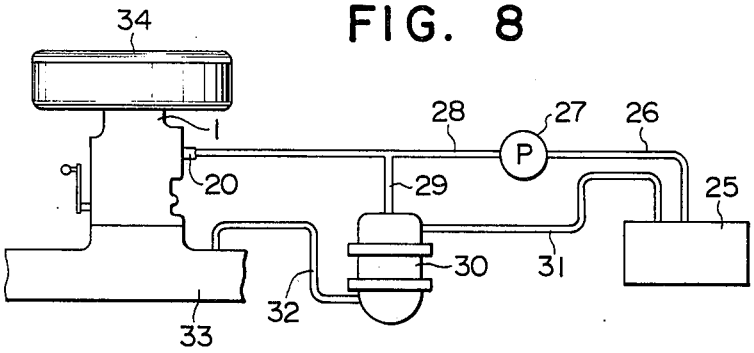
FIG. 8 is a diagram showing a fuel supply system in the variable Venturi carburetor according to this invention wherein a fuel pressure regulating valve is incorporated.
Figure 9:
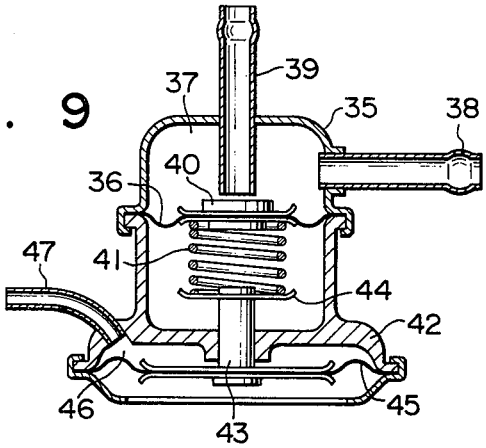
FIG. 9 is a longitudinal section of an embodiment of the fuel pressure regulating valve.

However, since the amount of intake air relatively decreases in a region where the intake manifold vacuum $Pm$ is lower than $Pc$, i.e., in a high load region of the engine, and air/fuel ratio $Ga/Gf$ is not maintained constant in this region, resulting in the generation of a too rich fuel-air mixture. To counteract this problem, the present invention further proposes to maintain the air/fuel ratio $Ga/Gf$ to be constant even in said operational region by lowering the fuel pressure $Pf$. FIG. 8 is a diagram of a fuel supply system for the carburetor according to the present invention, said system incorporating a fuel pressure regulating valve for regulating fuel pressure for the abovementioned compensation. FIG. 9 is a section showing an embodiment of the fuel pressure regulating valve. Referring to these figures, the fuel inlet tube 20 of the carburetor is supplied with fuel from a fuel tank 25 by way of a conduit 26, a fuel pump 27 and a conduit 28. A branch conduit 29 is branched from the conduit 28 and is connected to a fuel pressure regulating valve 30 so that the fuel separated from the main passage by the branch conduit 29 is returned to the fuel tank 25 through a conduit 31 according to the regulating operation of the fuel pressure regulating valve 30. The fuel pressure regulating valve 30 is supplied with intake manifold vacuum existing in an intake manifold 33 through a conduit 32. Element 34 designates an air cleaner connected to the carburetor body 1.

As shown in FIG. 9, the fuel pressure regulating valve comprises an upper housing 35 which defines a diaphragm chamber 37 closed by a diaphragm 36 at one end thereof. Toward the diaphragm chamber there opens a fuel inlet tube 39 connected with the branch conduit 29 and a fuel outlet pipe 38 connected to the fuel return conduit 31. An inner end of the fuel inlet tube 39 cooperates with a valve member 40 supported by the diaphragm 36 to constitute a valve structure. In more detail, the diaphragm 36 is resiliently urged upward as seen in the figure by a compression coil spring 41 and urged downward by the fuel pressure existing in the diaphragm chamber 37 to establish a balanced position which causes the valve member 40 to close the inner end of the fuel inlet tube 39 thereby intercepting the fuel return flow from the branch conduit 29 to the return conduit 31 in an operating condition, or locates the valve member 40 apart from the inner end of the fuel inlet tube 39 thereby allowing for a return flow of fuel from the branch conduit 29 to the return conduit 31 toward the fuel tank in another operating condition. A lower end of the compression coil spring 41 is supported by a dish member 44 which in turn is supported by a shaft member 43 slidably mounted in a lower housing 42 which is assembled with the upper housing 35 by calking. The lower housing 42 defines a diaphragm chamber 46, an end of which is closed by a diaphragm 45. The diaphragm chamber 46 is connected with an intake manifold vacuum inlet tube 47 which supplies intake manifold vacuum existing in the intake manifold through the conduit 32.

Figure 10:
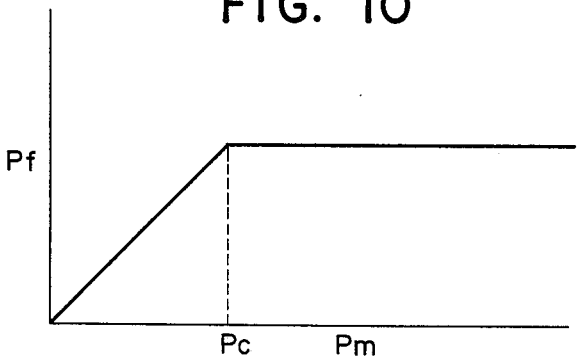
FIG. 10 is a graph showing a relation between fuel pressure regulated by said fuel pressure regulating valve and intake manifold vacuum; and, FIG. 11 is a graph showing a relation between intake manifold vacuum and fuel flow in the case where said fuel pressure regulating valve is employed.
Figure 11:
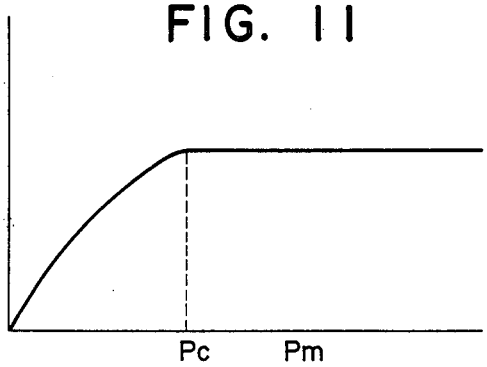

The carburetor according to the present invention equipped with the fuel pressure regulating valve as shown in FIGS. 8 and 9 operates as follows:

The fuel pump 27 delivers fuel at a pressure which is higher than a predetermined pressure level to be supplied to the fuel inlet tube 20 of the carburetor. A portion of the fuel delivered by the fuel pump is returned to the fuel tank 25 through the branch conduit 29, the fuel pressure regulating valve 30 and the return conduit 31, whereby said predetermined pressure level is constantly maintained. In this condition, the diaphragm chamber 46 of the fuel pressure regulating valve 30 is supplied with an inlet manifold vacuum which is higher than $Pc$, whereby the diaphragm 45 is pulled upward as seen in FIG. 9 as much as its full stroke thereby positioning the shaft member 43 at its most raised position. Therefore, the diaphragm 36 is applied with the largest compression force which is exerted by the compression coil spring 41. The fuel pressure regulating valve 30 is designed so that said predetermined pressure level is maintained under this condition by the operation of the valve structure constituted by the valve member 40 and the inner end of the fuel inlet tube 39. Thus, as long as the intake manifold vacuum applied to the diaphragm chamber 46 is higher than $Pc$, the pressure of fuel supplied to the fuel inlet tube 20 of the carburetor is maintained at said predetermined pressure level. However, if the intake manifold vacuum lowers below $Pc$, the diaphragm 45 moves downward by the reaction force applied by the compression coil spring 41, resulting in a decrease of the spring force applied to the diaphragm 36 by the compresssion coil spring 41. Then the amount of fuel returned through the fuel pressure regulating valve 30 increases thereby reducing the pressure of fuel supplied to the fuel inlet tube 20. The relation between the intake manifold vacuum $Pm$ and the fuel pressure $Pf$ is shown in FIG. 10. When the fuel pressure $Pf$ varies as shown in FIG. 10, the fuel flow $Gf$ supplied by the carburetor varies as shown in FIG. 11, i.e. the fuel flow $Gf$ is proportional to $\sqrt{Pf}$, provided that area $Af$ of the annular fuel passage defined by the metering jet 21 and the metering rod 22 is maintained constant. Since there is a similar relation as shown in FIG. 5 between the intake manifold vacuum $Pm$ and the air flow $Ga$, the air/fuel ratio $Ga/Gf$ is maintained to be constant for any value of $Pm$ or over the entire operational region of the engine, as apparent from comparison of FIGS. 5 and 11.

As explained above, the variable Venturi carburetor according to this invention makes it possible to establish the acoustic speed of air flow passing through the Venturi throat for the most part of operational region of the engine, thereby providing for quite favorable atomization of fuel by the fuel being injected into air flow at the acoustic speed. Thus, the fuel combustion performance in the engine is improved. Since fuel is injected into the air flow at a predetermined pressure and by a predetermined amount, the carburetor shows a good transient response characteristic, whereby exhaust gas characteristic and drivability of the engine is improved. Since the flow of air passing through the Venturi throat reaches the acoustic speed during most of the operational region of the engine, metering of air is accurately performed, whereby metering of fuel can be accurately performed in proportion to the amount of air flow thereby accomplishing accurate air/fuel ratio performance. This, of course, contributes to the improvement of exhaust gas characteristic of the engine. By the provision of the fuel pressure regulating valve, even in an operational region wherein the air flow speed at the Venturi throat is lower than the acoustic speed, a non-linear variation of fuel is accomplished, thereby allowing for establishing accurate air/fuel ratio and, accordingly, improved exhaust gas characteristic throughout the entire operational region of the engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A variable Venturi carburetor for gasoline engines which comprises:

a body member which defines therein a passage including a pair of sectorially concaved portions;

a pair of opposing sectorial elements received by said concaved portions and defining a Venturi passage therebetween;

a fuel nozzle means disposed to traverse a throat portion of said Venturi passage;

means for moving said pair of sectorial elements to vary the flow area of said throat portion;

a fuel supply passage connected with said fuel nozzle means for supplying fuel thereto;

said fuel supply passage including a variable orifice means which is controlled in relation to the movement of said sectorial elements so that the flow area of said orifice means is proportional to that of said throat portion;

a fuel pressure control valve which includes a biasing element actuated by the intake manifold vacuum of the engine;

said valve delivering fuel at a constant pressure when said vacuum is greater than a predetermined value which generates an acoustic air flow through said throat opening, and at a pressure proportional to said vacuum when it is smaller than said predetermined value;

said fuel pressure regulating valve including a first diaphragm valve which comprises a relief valve structure operated by a diaphragm;

said diaphragm being controlled by a spring force and a second diaphragm which is actuated by the intake manifold vacuum;

said first diaphragm supports a valve member which cooperates with an end portion of a tube which is branched from the fuel supply passage;

said valve structure controlling the flow of fuel to be branched from said fuel supply passage and returned to a fuel tank;

said first diaphragm being urged towards said inner end of said tube by a compression coil spring which is supported at an opposite end by said second diaphragm; and said second diaphragm being driven by the intake manifold vacuum so that it supports said opposite end of said compression coil spring at a predetermined limit position when the intake manifold vacuum is equal or greater than said predetermined value and is shifted rearward to loosen said compression coil spring when the intake mainfold vacuum is smaller than said predetermined value.

2. The variable Venturi carburetor of claim 1, wherein said pair of opposing sectorial elements are pivotally mounted about one of their end portions, said sectorial elements being rotated about their end portions to vary the flow area of said throat portion.

3. The variable Venturi carburetor of claim 1, wherein the fuel supply passage is connected at its other end to a fuel tank, a branch conduit is provided to extend from said fuel supply passage, said branch conduit containing said fuel pressure control valve, a return conduit is provided for returning fuel separated from the fuel supply passage to the fuel tank according to the regulating operation of the fuel pressure control valve, and conduit means are utilized for providing communication between the fuel pressure control valve and the intake manifold for supplying said control valve with the vacuum existing in the intake manifold.

4. The variable Venturi carburetor of claim 1, wherein the sectorial elements are operatively connected with the acceleration pedal for opening or closing said elements in response to the operation of the acceleration pedal.

* * * * *